US005555589A

United States Patent [19]

Moultrie

[11] Patent Number: 5,555,589

[45] Date of Patent: Sep. 17, 1996

[54] GOLF CLUB AND GOLF SHOE CLEANING DEVICE

[76] Inventor: Daniel L. Moultrie, 2058 Mills Ave., Claremont, Calif. 91711

[21] Appl. No.: 408,638

[22] Filed: Mar. 22, 1995

[51] Int. Cl.[6] ..... A46B 5/02; A46B 9/02; A46B 15/00

[52] U.S. Cl. ..... 15/105; 15/160; 15/161; 7/164; 33/760; 224/162; 224/274; 242/371; 242/400; D4/116; D4/127; D4/130

[58] Field of Search ..... 15/105, 159.1, 15/160, 161, 246; 7/164; 248/317, 321; 224/274, 162; 242/371, 379, 379.2, 400, 400.1, 588; D4/116, 127, 130; 33/760, 770; 273/32 B

[56] References Cited

U.S. PATENT DOCUMENTS

| | | | |
|---|---|---|---|
| D. 202,613 | 10/1965 | Lion | 15/160 |
| D. 339,473 | 9/1993 | Lewis et al. | D4/127 |
| 575,159 | 1/1897 | Johnson | 15/105 |
| 831,391 | 9/1906 | Ubellar | 15/246 |
| 1,963,326 | 6/1934 | Greenwood | 242/400 |
| 2,253,269 | 8/1941 | Gaddis | 15/246 |
| 2,857,608 | 10/1958 | Schwartz | 15/111 |
| 3,047,896 | 8/1962 | Gunderson | 15/160 |
| 3,350,736 | 11/1967 | Frazelle et al. | D4/116 |
| 5,203,048 | 4/1993 | Bynum | 15/160 |
| 5,230,117 | 7/1993 | Johnson et al. | 15/106 |

OTHER PUBLICATIONS

Catalog #386–513 sold by Golf Day Inc.—375 Beachham St. Chelsea, MA 02150.

*Primary Examiner*—Mark Spisich

[57] ABSTRACT

A golf club and golf shoe cleaning device with an extendable tether (12) that is attachable to a golf bag or other convenient surface. The device includes a container (10) with two opposed ends. A back end (17) which has a surface suitable for printing and a front end (14) which serves as a cap or lid for the container (10). The front end (14) includes brush bristles (11) extending away from the exterior of the front end (14). The device further includes within the container (10) a coiled spring (22) powered revolvable hub (21) to which one end of a flexible tether (12) is attached. The flexible tether (12) is wound around the revolvable hub (21) and then exits the container (10) through an aperture (13) and is available to be attached to a golf bag or other convenient surface.

4 Claims, 3 Drawing Sheets

GOLF CLUB AND GOLF SHOE CLEANING DEVICE

BACKGROUND—FIELD OF INVENTION

This invention relates to portable golf club and shoe cleaning devices, more specifically to brushes that are attachable to a golf bag by an extendable tether.

BACKGROUND—DESCRIPTION OF PRIOR ART

A large number of golfers carry club and shoe cleaning brushes while playing golf. From the prior art it is apparent that most of these cleaning brushes are of the "toothbrush" or linear variety, with a handle on one end and brush bristles near the opposite end. Some examples of this type would be U.S. Pat. No. 2,857,608 to Schwartz (1955) and a brush sold by Golf Day Incorporated as catalog #386-513. The brush sold by Golf Day Incorporated includes a swivel clip for attaching to a golf bag.

For ease of operation, many of these prior linear varieties were fitted with some means of extending their useful length of operation from the golf bag without having to detach it from the bag. A length of elastic cord that was supplied by the brush manufacturer or the golfer is a popular choice for this purpose. The elastic cord was simply attached to the brush handle on one end and attached to the golf bag on the other. One of the more recent inventions, U.S. Pat. No. 5,230,117 to Johnson (1993) improved on the elastic cord use by attaching a linear brush to a chain that is wound into a coiled spring powered case.

As useful as these prior arts are, they all suffer from a number of disadvantages.

a) Linear type brushes do not remain very compact. The long narrow shape of these brushes allows them to swing back and forth awkwardly from their attachment point while the golf bag is being carried. For example: the type of brush sold by Golf Day with an added swivel attachment clip has a total length of approximately twelve inches. When a length of elastic cord is attached between one end of any of these linear brushes and the golf bag it adds to the excessive length problem.

b) Linear type brushes are not very efficient in their ratio of area of brush bristles to overall area of the entire brush. For example: A linear or "toothbrush" type may be up to one foot in overall length, but the brush bristles may only occupy a one-half by one inch area near its end.

c) The type of brush that is attached to a chain that is wound into a coiled spring powered case allows the brush to be extended a greater distance from the golf bag than the attached elastic cord type above, but the brush that retracts to a coiled spring powered case still swings awkwardly, is heavier, and more expensive to manufacture.

d) Inexpensive golf accessories are a popular advertising medium. Heretofore, these brushes have been rarely selected for use in advertising because their thin linear design is too restrictive for print and/or too expensive, as in the example of the linear brush attached to a spring wound chain.

OBJECTS AND ADVANTAGES

Accordingly, several objects and advantages of my golf club and golf shoe brush are:

a) To provide a brush that can be extended by a tether from an attached point on a golf bag and will retract to a compact position after use.

b) To provide a tethered brush that is more efficient in its brush bristles to overall size ratio.

c) To provide a tethered brush that is relatively inexpensive to manufacture.

d) To provide a tethered brush that has an area conducive to advertising print media.

Further objects and advantages are to provide an attractive tethered brush that will be of durable construction, relatively lightweight, and can be manufactured in a variety of shapes, colors, and materials. Still further objects and advantages will become apparent from a consideration of the ensuing descriptions and drawings.

DESCRIPTION OF DRAWING FIGURES

FIG. 1. Shows a perspective view of the preferred embodiment of the invention with the brush portion in the foreground.

REFERANCE NUMERALS IN DRAWINGS

| | |
|---|---|
| 10 Container Body | 22 Wound Spring |
| 11 Brush Bristles | 23 Fixed Center Post |
| 12 Tether | 24 Tether with measuring indica |
| 13 Aperture | 25 Golf Bag Attachment Ring |
| 14 Container Front Cap | 26 Fixed Retaining Hub |
| 15 Container Front Cap Attachment Screw | 27 Elastic Tether |
| 16 Container Side | 28 Attatchment of Elastic tether |
| 17 Container Back | 29 Front Cap Sleeve |
| 18 Aperture for attachment Screw | 30 Front Cap aperture Notch |
| 19 Container Side Mating Edge | 31 Plurality of fixed Retaining Hubs |
| 20 Container Cap Mating Edge | 32 Brush Head Back |
| 21 Revolvable Hub | 33 Brush Head Front |

DETAILED DESCRIPTION OF FIGS. 1 THROUGH 9

Figure 1:
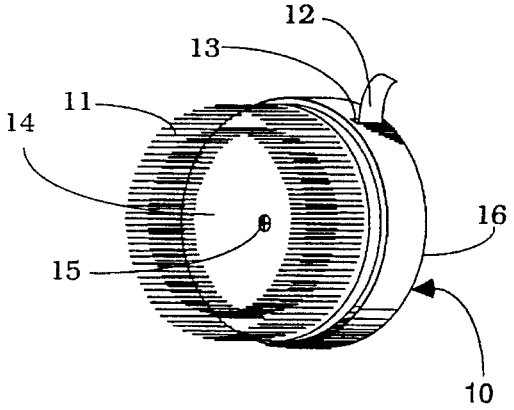
Figure 2:
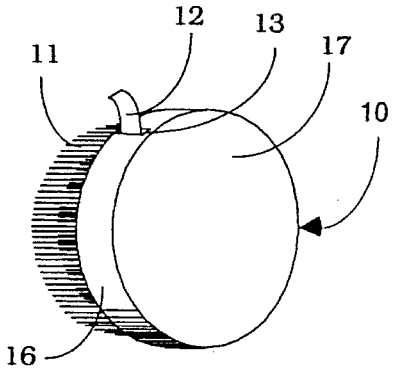
FIG. 2 Shows a perspective view of the preferred embodiment of the invention with the advertising print area portion in the foreground.
Figure 3:
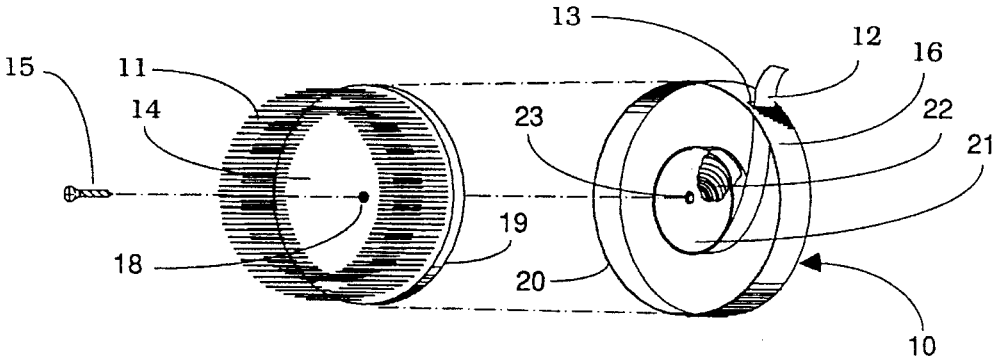
FIG. 3 Shows an exploded view of the preferred embodiment of the invention where as the tether is wound around a spring powered revolvable hub.

Referring to the drawings, the preferred embodiment of the golf brush invention is illustrated in FIG. 1 (front view), FIG. 2 (back view), and FIG. 3 (exploded view). Major components of the golf brush are generally indicated about container 10 comprising of a back 17 which is generally flat and suitable for printing or labeling and a container side 16. The term "side" is used because in the preferred embodiment, the container 10 is cylindrical in shape and has only one circular side 16 as illustrated in the drawings. The term "sides" would apply if, for example, the container were a cube or other container shape. The container side 16 includes an aperture 13 and a mating edge 20. Near the interior center of the container 10 is a fixed spindle post 23. In the preferred embodiment the container 10, including the back 17, side 16, aperture 13, and spindle post 23 is a semi-rigid plastic such as polyethylene and would be made as a single piece using the injection mold process.

To enclose the container 10, a container front cap 14 is used. The cap 14 includes a mating edge 19 which co-operates or mates with the container side mating edge 20 to form a finished seam or attachment bond. The container cap 14 includes a plurality of attached brush bristles 11 and an attachment screw aperture 18 near the center of the cap. Preferably, the front cap 14 and the brush bristles 11 are semi-rigid plastic, such as polyethylene, and would be manufactured as a single piece using the injection mold process. However, the brush bristles 11 may be of other material such as nylon or wire and be held by the molded container cap 14 as is well known to those skilled in the art.

Within the container 10 is a coiled spring 22 with the inside end of the spring 22 attached to or near the spindle post 23. The exterior end of the coiled spring 22 is attached to a revolvable hub 21. The revolvable hub 21 generally encloses the coiled spring 22. The center of the hub 21 has a hole large enough to slide onto the spindle post 23 without friction. Attached to the exterior of the hub 21 is one end of a flexible tether 12. The tether 12 is wound around the hub 21 in a direction that would urge the now spring powered revolvable hub 21 to rewind the tether 12 around the hub 21 after being unwound by pulling the free end of the tether 12 away from the hub 21. The flexible tether 12 exits the container 10 through the container side aperture 13 and is available to be tied to a golf bag. A front cap attachment screw 15 passes through the cap aperture 18 and is screwed into the spindle post 23. The head of the attachment screw 13 should be large enough so as not to pass through the cap aperture 18 thereby attaching the front cap 14 to the container 10.

Figure 4:
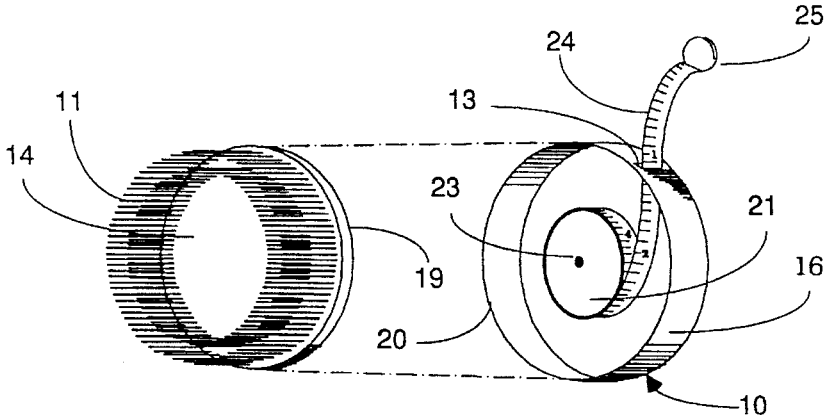
FIG. 4 Shows an exploded view of a typical embodiment of the invention where as the tether is marked to indicate measurements of length and the tether includes an attachment ring.
Figure 5:
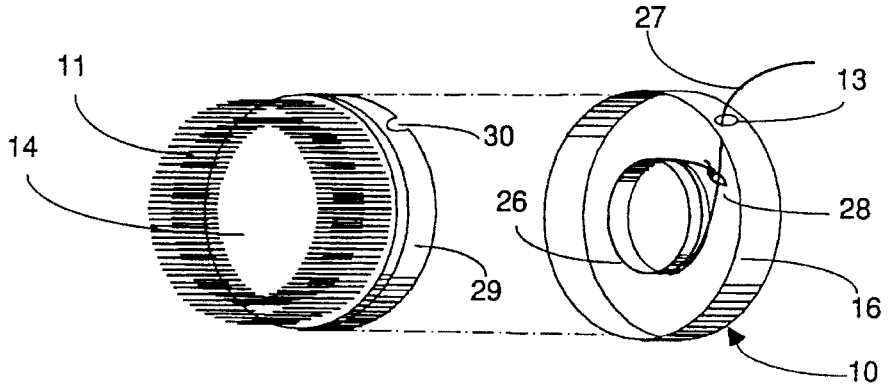
FIG. 5 Shows an exploded view of atypical embodiment of the invention where as the tether is elastic and is wound around a fixed retaining hub.
Figure 6:
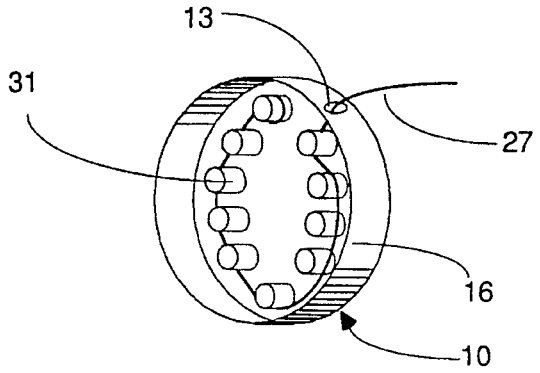
FIG. 6 Shows the container portion of a typical embodiment where as the tether is elastic and is wound around a plurality of fixed retaining hubs.
Figure 7:
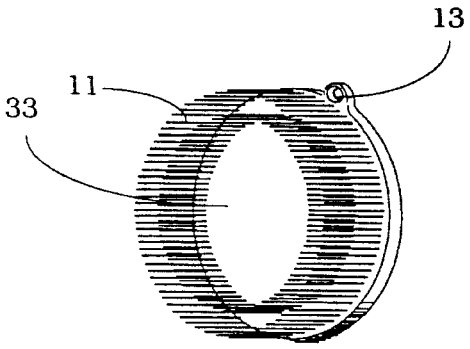
FIG. 7 Shows a perspective view of a simple embodiment of the invention where as the brush is a single body of material and includes an aperture for accepting a tether.
Figure 8:
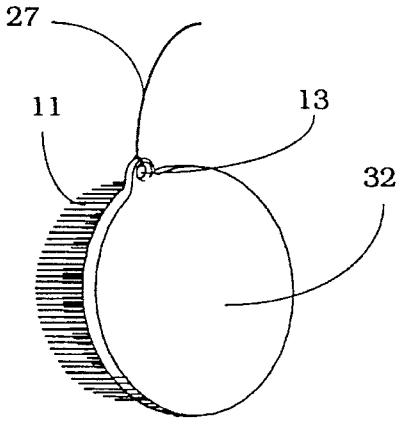
FIG. 8 Show a different perspective view of FIG. 7 and adds an elastic tether attached to the aperture.
Figure 9:
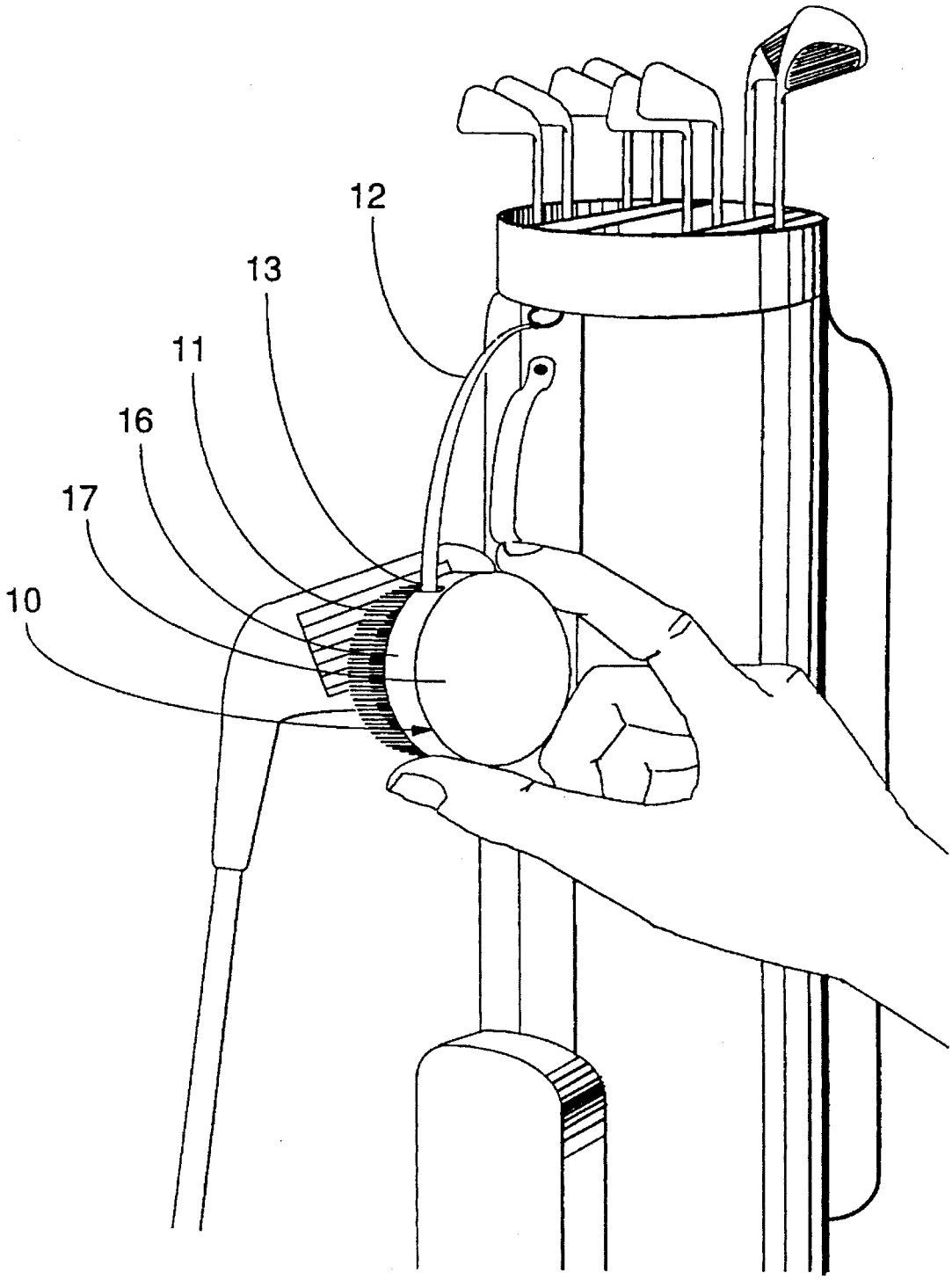
FIG. 9 Shows a perspective view of one embodiment of the invention illustrating one type of use.

The art of using a wound spring powered hub to retract a tether is decades old. A popular current use for this art is in hand held retractable measuring tapes sold as a hardware item and as a sewing accessory. Since there are many varieties of these items available, a manufacturer may gain additional knowledge from observing some of these designs. Additional embodiments are illustrated in FIG. 4, FIG. 5, and FIG. 6. In FIG. 4 the tether 24 is marked to indicate a measurement of length. The tether 24 includes an spiral attachment ring 25 for attachment to the golf bag and the container cap mating edge 20 "snaps-on" to the side mating edge 19 using the tab and groove technique which is well known to those skilled in the art. FIG. 5 illustrates another embodiment whereas an elastic tether 27 is wound around a fixed retaining hub 26. The interior end of the elastic tether 27 is tied around itself using a "Lasso" or "slip-knot" type attachment. The elastic tether 27 may also be attached to any fixed point within the interior of the container 10. The front cap in FIG. 5 also includes a front cap sleeve 29. The diameter of the sleeve 29 is small enough to slide tightly inside the container side 16. An adhesive is applied between the cap sleeve 29 and the container side 16 achieving an attachment bond. The cap sleeve 29 further includes an aperture notch 30 which aligns with the side aperture 13 to allow the elastic tether 27 to pass through. FIG. 6 illustrates how the elastic tether may be attached to and wound around a number of fixed retaining hubs. FIG. 7 illustrates a simple embodiment of the invention. It is a single body of material with two opposed sides. This perspective view shows the brush head front 33 which includes a plurality of brush bristles 11 and an aperture 13 to which a tether can be attached. Preferrably, this embodiment would be manufactured as a single piece using the injection molding technique from a semi-rigid plastic, such as polyethylene. However, the brush bristles 11 may consist of any suitable material such as nylon or wire and be held by the brush head front 33, as is well known to those skilled in the art. FIG. 8 shows a back perspective view of the embodiment in FIG. 7 with the brush head back 32 in the forground. The brush head back 32 is generally flat and suitable for printing or labeling. FIG. 8 further includes an elastic tether 27 that is attached to the aperture 13. FIG. 9 shows one type of use of the brush and how the advertising media area can be viewed while the brash is in use.

From the description above a number of advantages of the my tethered golf brush become evident:

a) My tethered brush will remain very compact. When the brush is not in use the majority of the tether is wound within the container, and only a minimal amount of the tether is required to be on the exterior for attachment to the golf bag. This, along with the elimination of a long handle used in other types of brushes keeps the brush in a very close position to the golf bag to minimize swinging.

b) My tethered brush has an improved ratio of brush bristle area to total brush area. The area available for brush bristles is almost 50% of the total area.

b) My tethered brush can be very inexpensive to manufacture. One embodiment requires only on part made of plastic and a length of elastic tether material.

c) A large area of the brush container is useful for advertising print or labels. In some cases the advertising message can even be better viewed while the brush is in use.

d) One of the embodiments of my tethered brush may also be used as a measuring device.

OPERATION —FIGS. 1 THROUGH 9

The operation of my tethered brush is fairly simple. Once the tether is attached to the golf bag by the tying or clip method, the user simply grasps the brush container by the side as illustrated in FIG. 9 and pulls it outwardly. In the embodiments shown in FIGS. 1, 2, 3, and 4 the tether is unwound from the spring wound revolvable hub. After use, the user releases the container and it is drawn back to the attachment point by being rewound onto the revolvable hub by the wound spring action. In the embodiments shown in FIGS. 5, 6 and 8 in which the tether is elastic, the user of the brush operates it identically as with the other embodiments. However, in FIGS. 5 and 6 the elastic tether is wound around one or more fixed retaining hubs within the container. As the brush is withdrawn from the golf bag, the elastic stretches over its entire length to allow for extention of the brush for use.

CONCLUSION, RAMIFICATIONS, AND SCOPE OF INVENTION

Accordingly, it is evident that my tethered brush invention is attractive, lightweight, economical, and easy to use. It is conducive to advertising media, and the container as well as the brush bristles may be manufactured in a variety of materials, sizes and colors. Obviously, many minor changes may be made in the form and construction of this invention without departing from the material spirit thereof. It is not, however, desired to confine the invention to the exact forms herein shown and described, but it is desired to include all such as properly come within the scope claimed.

I claim:

1. A golf club and golf shoe cleaning device comprising:

a container having two opposed ends, with the first end having an exterior surface suitable for printing, and the second end having a plurality of brush bristles extending outwardly from the exterior surface of said second end, the container further includes an aperture between said opposed ends; passing through the aperture is a flexible tether, the flexible tether having two ends with the first end of said flexible tether residing outside said container and includes means for attachment to a convenient surface; the second end of said flexible tether is attached to and wound around a coiled spring powered revolvable hub that resides within said container, the spring being wound within the revolvable hub in a direction that urges said flexible tether to rewind on said hub after it has been reeled out of said container by a manual withdrawing force.

2. The device in claim 1 wherein said flexible tether is marked to indicate measurements of length.

3. A golf club and golf shoe cleaning device comprising:

a container having two opposed ends, with the first end having an exterior surface suitable for printing, and second end having a plurality of brush bristles extending outwardly from the exterior surface of said second end, the container further including an aperture between said opposed ends; passing through the aperture is a elastic tether, the elastic tether having two ends with the first end of said elastic tether residing outside said container and includes means for attachment to a convenient surface; the second end of said elastic tether is attached to and wound around tether retaining means inside said container.

4. The device in claim 3 wherein said elastic tether is attached to and wound around a plurality of tether retaining means inside said container.

* * * * *